US007408471B2

(12) United States Patent
Thompson

(10) Patent No.: US 7,408,471 B2
(45) **Date of Patent: *Aug. 5, 2008**

(54) METHOD, APPARATUS, AND SYSTEM FOR REMOTE BABY MONITORING WITH ADDITIONAL FUNCTIONS

(75) Inventor: Rick L. Thompson, Burlington, IA (US)

(73) Assignee: Graco Children's Products Inc., Exton, PA (US)

( * ) Notice: Subject to any disclaimer, the term of this patent is extended or adjusted under 35 U.S.C. 154(b) by 71 days.

This patent is subject to a terminal disclaimer.

(21) Appl. No.: 11/439,045

(22) Filed: May 23, 2006

(65) Prior Publication Data

US 2006/0220884 A1 Oct. 5, 2006

Related U.S. Application Data

(63) Continuation of application No. 11/113,650, filed on Apr. 25, 2005, now Pat. No. 7,053,779, which is a continuation of application No. 09/957,776, filed on Sep. 21, 2001, now Pat. No. 7,009,520.

(60) Provisional application No. 60/234,577, filed on Sep. 22, 2000.

(51) Int. Cl.
*G08B 23/00* (2006.01)

(52) U.S. Cl. ..... 340/573.1; 340/539

(58) Field of Classification Search ..... 340/573.1, 340/539, 531, 407.1, 965, 825.19; 367/197, 367/198, 199; 381/56, 57, 58, 122
See application file for complete search history.

(56) References Cited

U.S. PATENT DOCUMENTS 3,911,899 A 10/1975 Hattes
4,198,603 A 4/1980 Aldridge et al.
4,237,449 A 12/1980 Zibell
4,297,677 A 10/1981 Lewis et al.
4,365,238 A 12/1982 Kollin
4,853,674 A 8/1989 Kiss
4,879,759 A 11/1989 Matsumoto et al.
5,178,309 A 1/1993 Bicheler et al.
D347,218 S 5/1994 Shuler
5,319,355 A 6/1994 Russek
D348,879 S 7/1994 Shuler
5,388,992 A 2/1995 Franklin et al.
5,400,012 A 3/1995 Walton
5,515,865 A 5/1996 Scanlon
5,628,056 A 5/1997 Grysiewicz et al.
5,638,824 A 6/1997 Summers
5,646,589 A 7/1997 Murray et al.
5,648,999 A 7/1997 Easterling et al.
5,649,321 A 7/1997 Kellenberger
5,651,049 A 7/1997 Easterling et al.

(Continued)

OTHER PUBLICATIONS

U.S. Appl. No. 60/116,426, filed Jan. 20, 1999, Goldstein.

(Continued)

*Primary Examiner*—John A Tweel, Jr.
(74) *Attorney, Agent, or Firm*—Lempia Braidwood LLC

(57) ABSTRACT

A method, apparatus and system for remote baby monitoring is disclosed. The invention includes a non-audio alert such as a vibrator. In one embodiment the invention includes an intensity adjustment or a sensitivity adjustment.

10 Claims, 5 Drawing Sheets

U.S. PATENT DOCUMENTS

| | | | |
|---|---|---|---|
| 5,666,331 | A | 9/1997 | Kollin |
| 5,678,739 | A | 10/1997 | Darling et al. |
| 5,684,460 | A | 11/1997 | Scanlon |
| 5,853,005 | A | 12/1998 | Scanlon |
| 5,864,291 | A | 1/1999 | Walton |
| D405,020 | S | 2/1999 | Shuler |
| 5,867,105 | A | 2/1999 | Hajel |
| 5,914,660 | A | 6/1999 | Mesibov et al. |
| 5,917,414 | A | 6/1999 | Oppelt et al. |
| 6,011,477 | A | 1/2000 | Teodorescu et al. |
| 6,043,747 | A | 3/2000 | Altenhofen |
| 6,091,329 | A | 7/2000 | Newman |
| 6,118,376 | A | 9/2000 | Regester |
| 6,127,931 | A | 10/2000 | Mohr |
| 6,127,936 | A | 10/2000 | Gendel et al. |
| 6,144,314 | A | 11/2000 | Yasue |
| 6,225,913 | B1 | 5/2001 | Slomowitz et al. |
| 6,257,659 | B1 | 7/2001 | Wilkins et al. |
| 6,280,392 | B1 | 8/2001 | Yoshimi et al. |
| 6,683,526 | B2 | 1/2004 | Bellin |
| 7,009,520 | B2 | 3/2006 | Thompson |
| 7,053,779 | B2 | 5/2006 | Thompson |
| 2001/0044588 | A1 | 11/2001 | Mault |

OTHER PUBLICATIONS

National Invention Services, Inc. "New Product Available for Licensing" Product #3846 3 pages; Aug. 15, 1997.

Technology & Travel, The News Journal "Bringing up Baby? Here's the latest buzz" Phil Milfored, Oct. 20, 1997 article, 1 page.

National Invention Services, Inc. "Baby Beeper With Vibration & Sound Alert", New Release, License Department, #3846, 1 page, Dec. 23, 2004.

Correspondence obtained from Kevin Brown regarding baby beeper from 1997-1999 (36 pages).

Updated drawings obtained from Kevin Brown (3 pages), Dec. 23, 2004.

METHOD, APPARATUS, AND SYSTEM FOR REMOTE BABY MONITORING WITH ADDITIONAL FUNCTIONS

CROSS REFERENCE TO RELATED APPLICATION

This application is a continuation of application Ser. No. 11/113,650, filed Apr. 25, 2005, and to be assigned U.S. Pat. No. 7,053,779, which is a continuation of application Ser. No. 09/957,776, filed Sep. 21, 2001, and issued as U.S. Pat. No. 7,009,520 on Mar. 7, 2006, which claims the benefit of provisional application Ser. No. 60/234,577, filed Sep. 22, 2000, the disclosures all of which are hereby specifically incorporated by reference in their entirety.

BACKGROUND OF THE INVENTION

1. Field of the Invention

This invention relates to a method, apparatus, and system for remote baby monitoring. More specifically, this invention relates to providing additional functions to a remote baby monitor including vibration and vibration adjustment.

2. Problems in the Art

There is an ever-growing number of people that wish to use baby monitors to monitor the condition of their babies or small children. This monitoring can be performed with a baby monitoring system. A baby monitoring system typically includes both a transmitter unit and a receiver unit. Some baby monitors broadcast the sounds from a baby from the transmitter unit to the receiver unit. This allows a parent, relative, babysitter, childcare provider, or other person to monitor a baby crying or a baby otherwise creating sound.

Use of a baby monitor permits a baby's caregivers some level of additional freedom. For example, instead of periodically checking on a baby throughout the night, parents will be immediately awakened if the baby is crying to indicate a need to be fed, changed, or otherwise comforted. Further, if caregivers do wish to periodically monitor the baby they can do so without getting out of bed unless the presence or absence of particular sounds indicates that further action is required. Additional freedom is afforded to caregivers at naptime. For example, caregivers can go outside and still be alerted if baby requires attention.

Baby monitoring can involve more than just determining if a baby is crying. The sounds or absence of sounds can indicate a number of different activities or conditions related to the baby. The particular sounds or lack of particular sounds can indicate if the baby is awake or asleep, breathing or not breathing, coughing, strangling, falling or climbing out of the crib. Based on what sounds are heard or not heard, a caregiver can make a decision concerning whether to respond or not. This prior art monitoring requires audio awareness of a parent, relative, babysitter, childcare provider, or other person who monitors a baby or child. In other words, the parent must be able to hear the receiver. In certain situations, the audio monitoring of prior art inventions does not provide adequate notice of a crying child or is otherwise inconvenient. For example, a parent could be using a vacuum cleaner, and be oblivious to a crying child as the parent would not be able to hear the baby monitor. Similarly, a parent could be located outside using a lawnmower or snow blower, for example, and would not be able to hear the remote baby-monitoring device. In these situations, the prior art devices would not be effective.

There is also the problem of using a prior art baby-monitoring device at nighttime. Such a device can wake up more than one person. For example, in a two-parent household where the parents share a bedroom, both parents would awaken even though only one parent is needed to care for baby. As can be appreciated, there are many situations in which either audio monitoring cannot be heard, or the audio monitoring is too distracting. If audio monitoring is too distracting, a person may just turn the baby monitor receiver off.

For example, if a parent receives an important phone call there may be difficulties in listening to both the phone call and listening to the baby monitor. Similarly, the parent may not want the other party to the phone conversation to hear the baby, should the baby begin to cry. In these and other situations, a parent may be inclined to simply turn the baby monitor off. If a baby monitor must be turned off, it is not serving any useful function.

Some attempts have been made to solve these problems using indicator lights. However, this solution is deficient in a number of ways. First, indicator lights require that the remote baby monitor always be in view of its operator. This can be problematic, as it requires that the operator's visual attention be directed towards these lights. An inattentive caregiver will not realize that lights are flashing or otherwise indicating that the baby may require attention.

It is therefore a primary objective, feature, or advantage of the present invention to provide an apparatus, method, and system which improves upon the state of the art.

It is another objective, feature, or advantage of the present invention to provide a system and method of baby monitoring.

It is a further objective, feature, or advantage of the present invention to provide an apparatus system and method of baby monitoring that permits remote monitoring with non-audio alert.

Yet another objective, feature, or advantage of the present invention is to provide a monitoring device that is wearable.

It is a further objective, feature, or advantage of the present invention to provide a means of communicating a baby's noises to a remotely located parent or other person.

It is yet another objective, feature, or advantage of the present invention to provide a baby monitor with improved transmission range.

Yet, a further objective of the present invention is to provide a remote baby monitoring system that can operate at multiple frequencies.

Yet a further objective of the present invention is to provide an alert with a vibrator to notify a remotely located parent or other person that a baby is crying.

Further objects, features, or advantages of the present invention include:

a. improved communication over a 900 megahertz channel.

b. adjustable volume level located at the remote receiver.

c. adjustment of the level of vibration located at the receiver.

These and other objectives, features, or advantages of the present invention will become apparent from the specification and claims.

SUMMARY OF THE INVENTION

The invention is a method, apparatus, and system for remote baby monitoring. The invention provides for non-audio alert when sound information associated with a baby exceeds a particular threshold. The invention provides for adjusting the level of sound that triggers the non-audio alert. This adjustment can be made on the remote unit. The invention further provides for adjustment of the intensity of the vibration on the remote unit.

In this manner, the present invention provides a number of advantages in that it provides a caregiver added flexibility in the baby monitoring process. For example, the caregiver who uses the remote monitoring system can adjust the level of non-audio alert as is appropriate for a particular baby being monitored or as is appropriate for a particular environment in which the baby or caregiver is situated.

DETAILED DESCRIPTION OF AN EXEMPLARY EMBODIMENT

Figure 1:
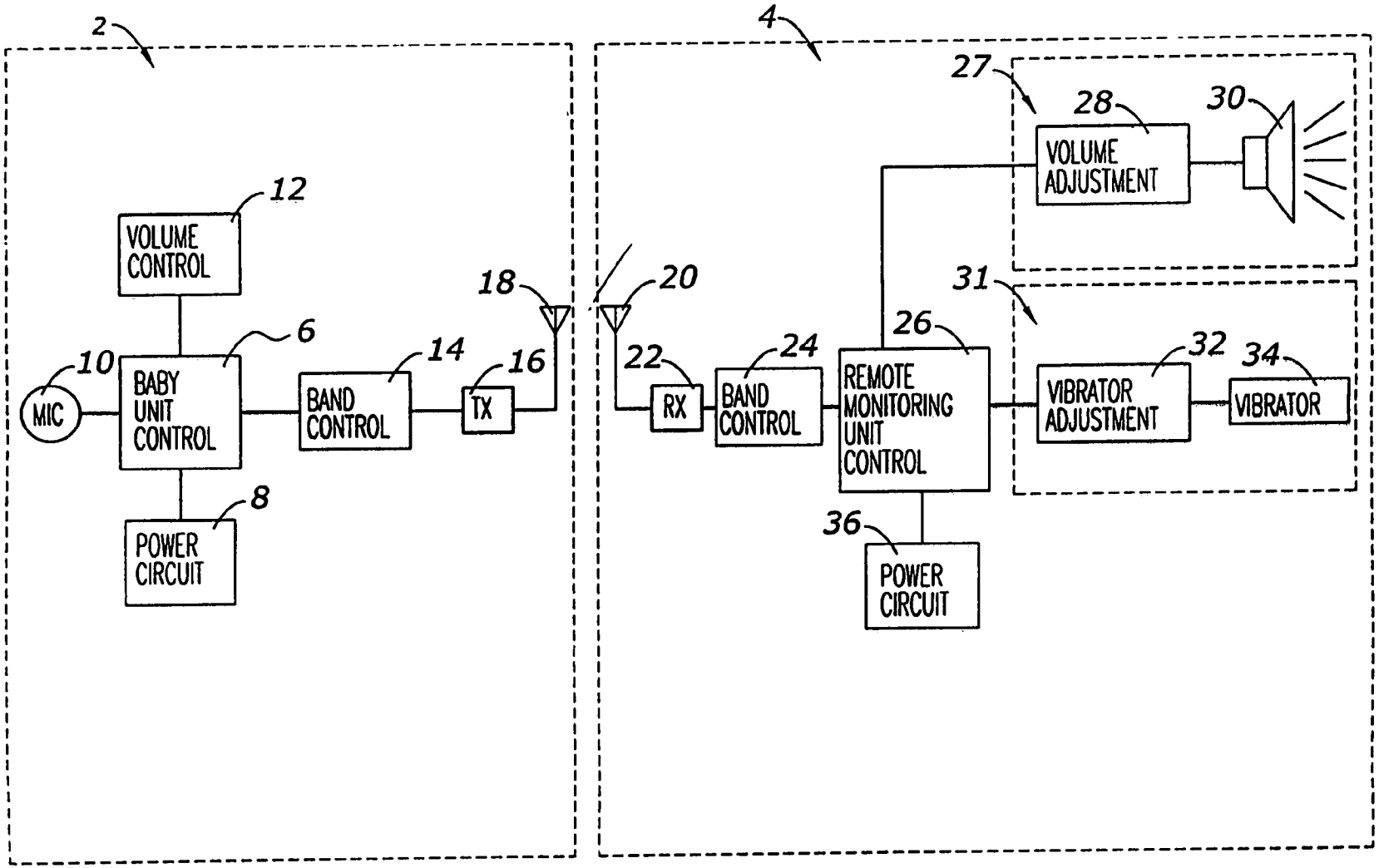
FIG. 1 is a block diagram of the baby monitoring system according to an exemplary embodiment of the present invention.

For a better understanding of the invention, an exemplary embodiment will now be described in detail. Frequent reference will be taken to the drawings. Reference numerals and letters will be used in the drawings to indicate certain parts and locations in the drawings. The same reference numerals or letter will indicate the same parts or locations throughout the drawings unless otherwise indicated.

FIG. 1 is a block diagram that shows an overview of the transmitter and receiver apparatuses. Transmitter 2 has a microphone 10, which is electrically connected to a control circuit 6. Volume control 12 and power circuit 8 are also connected to control circuit 6. The microphone 10 can be a microphone, a microphone element, transducer or other device that can be used as a sound level detector. It is to be understood that the volume control 12 may also be directly connected to microphone 10. The volume control 6 permits a parent or other person to adjust the level of the volume. This provides control over the sensitivity of the sound that is eventually transmitted. The use of volume control 6 is optional and preferred. Without volume control 6, a parent may have to physically move the transmitter unit 2 to varying distances from the baby in order to adjust sensitivity.

The baby unit control 6 provides the circuitry for connecting the inputs and outputs of the apparatus. The baby unit control 6 is also connected to a band control circuit 14 which is connected to transmitter 16 which is connected antenna 18. The band control unit 14 permits the transmitter 16 to transmit at different frequencies. The ability to operate at various frequencies can be important. For example, where only one frequency is used, there may be interference on that frequency. This interference could be due to a neighbor using a baby monitor operating at the same frequency. The interference could also be due to portable telephones or other consumer devices operating on the same frequency. The use of multiple frequencies selected through the band control unit 14 reduces or eliminates these problems.

It is to be understood that the band control unit is optional, and the number of different bands at which the transmitter can operate can vary in number. The transmitter 16 can be, for example, a 900 megahertz transmitter. Antenna 18 can be a soft antenna or other antenna. A soft antenna is generally preferable, given the environment in which the transmitter operates and the possibility that at some point the antenna 18 could come in contact with baby.

In the receiver unit 4, the antenna 20 receives a signal transmitted from the baby-transmitting unit 2. The antenna 20 may also be a soft antenna. The signal received through the antenna 20 goes to the receiver 22. The receiver 22 should be set to operate on the same frequency as the transmitter 16. For example, both the transmitter 16 and the receiver 22 can have an operating frequency of approximately 900-megahertz. In one embodiment the transmitter and the receiver can operate selectively at either 905.504 megahertz or 906.016 megahertz. The receiver 22 is also connected to the band control 24. The present invention contemplates that different bands can be manually or automatically selected. The band control unit 24 is electrically connected to the remote monitoring unit control. It is to be understood that the remote monitoring unit control 26 provides control circuitry and/or control logic to the other components of the remote receiver 4. The remote monitoring unit control 26 is also connected to an audio system 27, which provides audio of the baby, which was originally received at the microphone 10. The audio unit 27 has a volume adjustment 28 and a speaker 30. The volume adjustment provides the ability to adjust the volume level. For example, new parents can adjust the volume level to a high gain position so that every sound made by baby is heard in an amplified manner. Similarly, a parent with a very vocal baby can turn the volume level down so that only the loudest cries are clearly heard. The remote monitoring unit control 26 is also connected to a vibration system 31. The vibration system includes a vibration adjustment 32 as well as a vibrator 34. In addition, the remote monitoring unit control 26 is connected a power circuit 36.

Figure 2:
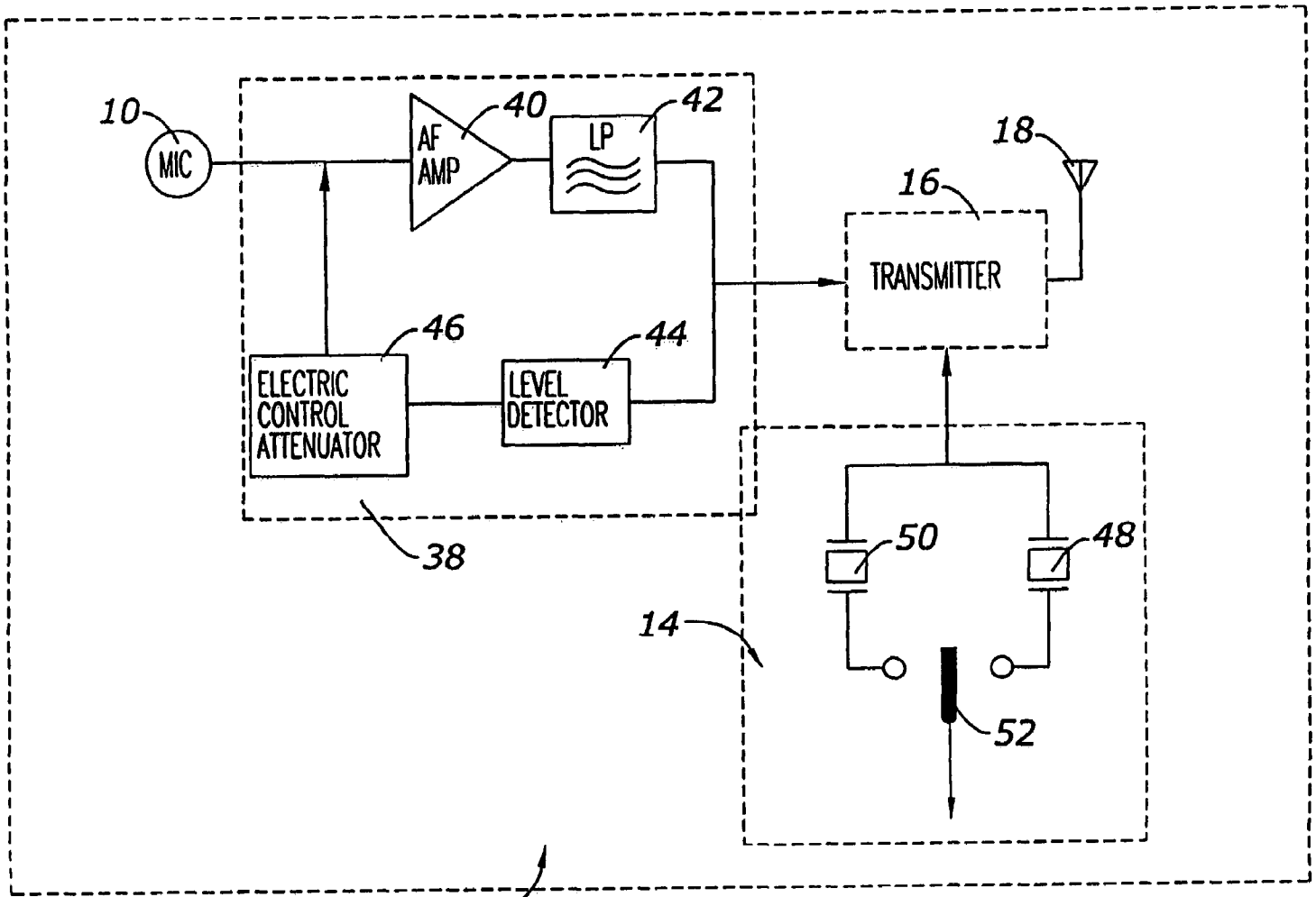
FIG. 2 is a detailed diagram of the transmitter unit in the baby monitoring system.

FIG. 2 shows a detailed diagram of one embodiment of a baby-monitoring unit. In the specific embodiment of FIG. 2, a signal-conditioning unit 38 is used. The microphone 10 is electrically connected to the signal-conditioning unit 38, which in turn is electrically connected to the transmitter 16. The signal conditioning unit 38, includes an audio frequency amplifier 40 electrically connected to a low pass filter 42 which is electrically connected to the transmitter 16. In addition, there is a feedback loop in the signal conditioning circuit 38. In this loop, the low pass filter 42 is also electrically connected to a level detector 44, which is electrically connected to the electric control attenuator 46. The electric control attenuator 46 is electrically connected to the input of the audio frequency amp 40. This feedback circuit provides a means in which the volume level can be adjusted to a range that is appropriate. The transmitter 16 also may operate at different frequencies or bands. The band selection circuit 14 allows the transmitter 16 to operate at either the frequency represented by crystal 48 or the frequency represented by crystal 50 as selected with the band selector switch 52. It is to be understood that the frequency of transmission is not necessarily the same frequency associated with the crystal. The frequency of transmission is derived from the crystal frequency. For example, but without limitation, the frequency of the transmission may be a multiple of the frequency associated with the crystal. Thus, in one embodiment a clock frequency of either 28.313 megahertz or 28.297 megahertz can be used, and this clock frequency can be multiplied by 32 to result in a frequency of 906.016 megahertz or 905.504 megahertz. It is to be appreciated that any number of frequencies are contemplated by the present invention. The present invention also provides that the frequency need not be selected with crystals, but may also be selected with oscillators, RC circuits, and other types of clock circuits as are well known in the art.

Figure 3:
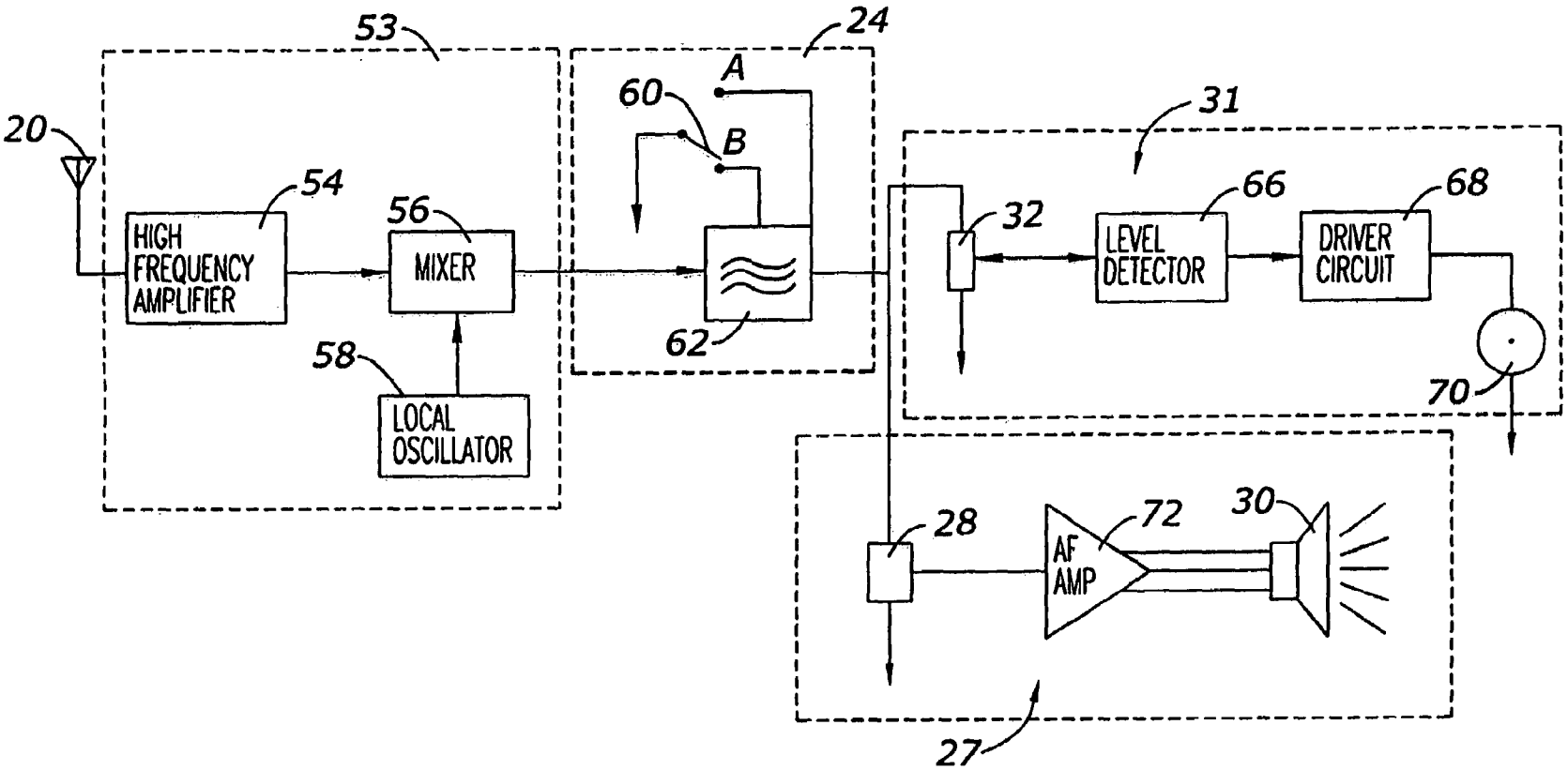
FIG. 3 is a detailed diagram of the baby monitoring receiver unit.

FIG. 3 shows a detailed diagram of the receiver circuit. The receiver conditioning circuit 53 includes a high frequency amplifier 54, electrically connected to a mixer 56. The local oscillator 58 is electrically connected to the mixer 56 as well. The output of the mixer 56 is electrically connected to a band pass filter 62. The frequency range of the band pass filter 62 is determined in part by the band or frequency selected through the band selection switch 60. The band control unit 24 is also connected to an audio circuit 27. This audio circuit includes a volume adjustment 28 connected to an audio frequency amp 72 which drives the speaker 30. The output of the filter 62 goes both to the input of the audio circuit 27 as well as an input to the vibration circuit 31. More specifically, the output of filter 62 is electrically connected to a vibration adjustment 32. The vibration adjustment is electrically connected to a level detector 66. The level detector 66 is electrically connected to a driver circuit 68. The driver circuit 68 is electrically connected to a motor 70. The motor 70 is a vibration motor or equivalent. The vibration motor 70 is preferably small in size such as a coin type vibration motor. Vibration motor can be a permanent magnet coreless DC motor, although the present invention contemplates other types of vibration motors and their equivalents. Preferably, the vibration motor 70 operates at low voltages such as 3.0 volts or lower. The driver circuit 68 provides an electrical interface capable of controlling the motor 70. Adjusting the level through the level adjustment 32 provides a change in vibration at the motor 70. The present invention provides for the level adjustment to be made manually by a user or automatically. For example, in one embodiment, a caregiver can set a threshold through use of an adjustable dial, switch, or other user operable control. The caregiver is not alerted by vibration unless the level of the alert exceeds the threshold set by the user. Further, where an automatic level adjustment is used, the level of vibration (i.e. the speed of a motor) can correspond to the level of the audio signal associated with the baby monitor.

Figure 4:
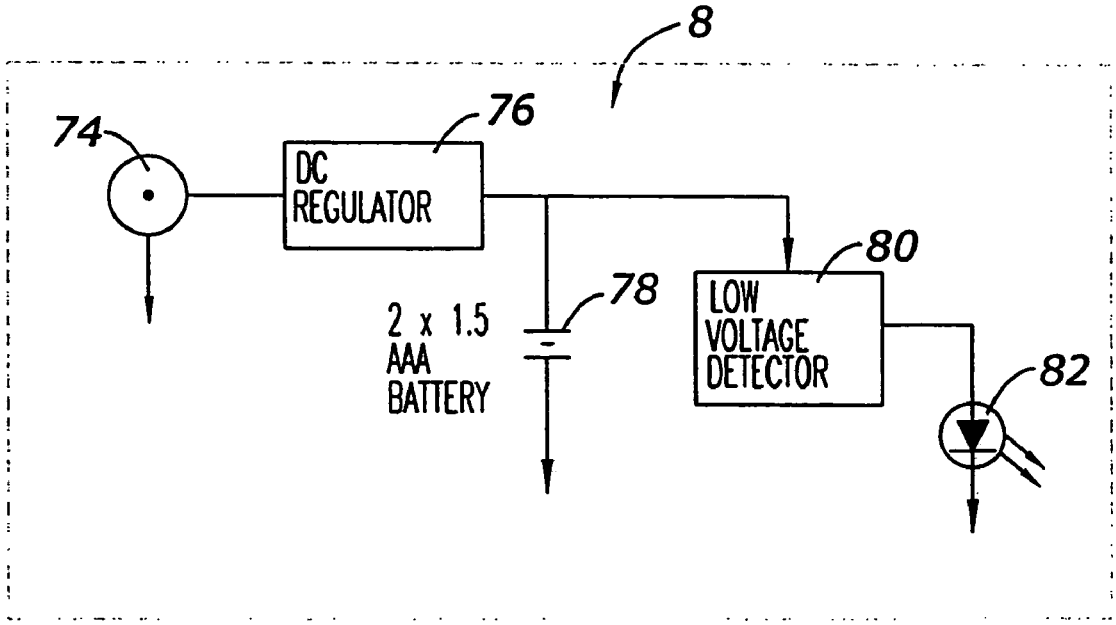
FIG. 4 is a schematic of a power circuit.

FIG. 4 shows the power circuit of transmitter 2. The power circuit consists of a DC input 74 electrically connected to a DC regulator 76. The output of the DC regulator 76 is electrically connected to a battery 78 and a low voltage detector 80. Thus, either the regulated DC input, or the battery input can be received at the low voltage detector 80. The low voltage detector 80 can then optionally drive a low voltage indicator light emitting diode (LED) 82. This low voltage indicator can provide an alert to the user that a battery needs to be replaced or the DC input voltage is not at the appropriate level. It is to be understood that the present invention contemplates that other power circuits can be used and that only a DC input or only a battery need be used. It is further understood that the power circuit 8 and its variations could be used as the power circuit 36 of the receiver unit. In the preferred embodiment of the power circuit 36, there need not be a DC input or DC regulator in the power circuit 36, only a battery is needed. This provides additional mobility of the remote unit. The use of batteries, which may be rechargeable, permits the remote unit to be easily transported.

Figure 5:
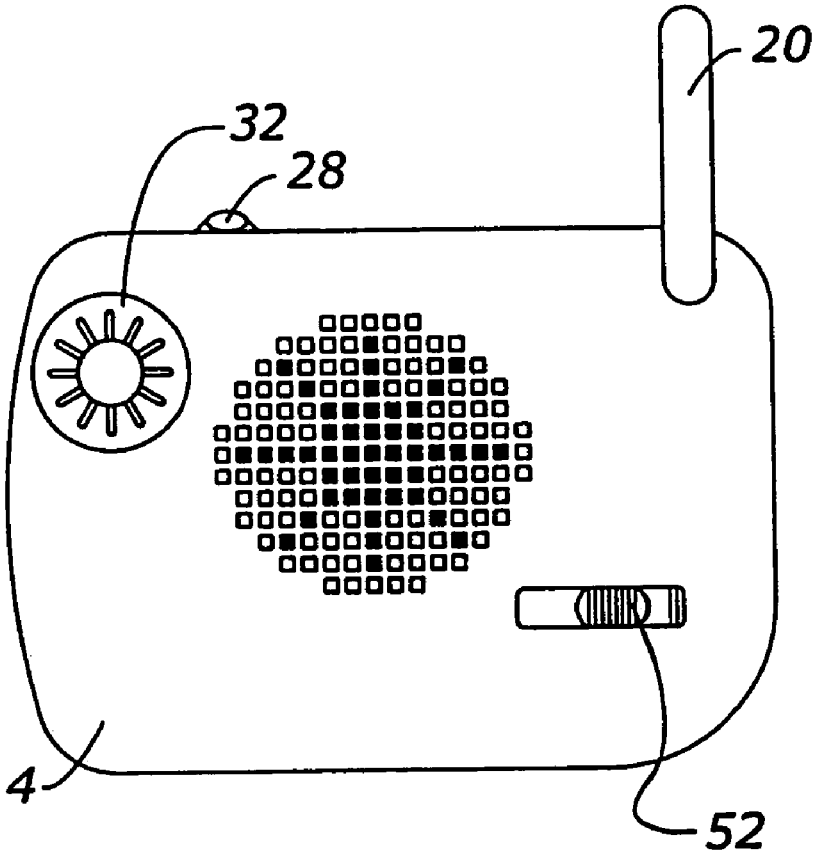
FIG. 5 is a pictorial representation of the receiver unit.

FIG. 5 best shows such a remote unit that can be easily transported. In addition, the remote unit may be contained within a small housing as shown in FIG. 5. The housing may optionally have a belt clip or strap so that the remote unit can be easily carried. As shown in FIG. 5, vibrator adjustment 32 can be used to control the level of vibration. Thus vibrator adjustment 32 can be used as a sensitivity control, providing more or less vibration as desired by the caregiver. For example, when the vibrator adjustment 32 is a dial, a caregiver can turn the vibrator adjustment 32 to increase sensitivity. For instance, to test that the vibration aspect of the invention is working properly, a caregiver can adjust the sensitivity to a level so sensitive that the vibration unit vibrates continuously. Similarly, the caregiver can adjust the sensitivity to a level such that any sound louder than breathing causes the vibrator to vibrate. The caregiver can also adjust the sensitivity level to a point where only the loudest of cries causes the vibrator to vibrate. The present invention contemplates that a caregiver can adjust the sensitivity level in these and other ways. This allows the caregiver to control the level of vibrational notification given as is appropriate for a particular caregiver and a particular child.

Thus, an apparatus, method, and system for baby monitoring has been disclosed which solves problems and deficiencies in the art. From the foregoing, it will be observed that numerous variations and modifications may be effected without departing from the spirit and scope of the novel concepts of the present invention. It is understood that no limitation with respect to the specific embodiment illustrated herein is intended or should be inferred. The terms and expressions which have been employed herein are used as terms of description and not of limitation. There is no intent in the use of such terms and expressions to exclude any future equivalents of features shown and described herein, but it is recognized that various modifications are possible within the scope of the invention now claimed.

What is claimed is:

1. A system comprising:

a remote unit adapted to monitor sounds associated with a baby, the remote unit comprising: a receiver for receiving an audio signal at a first audio level and generating a second audio level; a level detector adapted to determine when the first audio level is above the second audio level, the level detector being operatively connected to a vibrating unit and adapted to activate the vibration unit when the first audio level exceeds the second audio level and for as long as the first audio level exceeds the second audio level; and a transmitter adapted to transduce sound associated with a baby and transmit the transduced sound to the remote unit.

2. The system of claim 1 wherein the remote unit further comprises a speaker for outputting the audio signal.

3. The system of claim 1 further comprising a user selectable frequency switch and wherein the receiver operates at a user-selectable frequency.

4. The system of claim 1 wherein the receiver operates at a frequency at or above approximately 900 megahertz.

5. A new method of baby monitoring comprising:

transducing sound associated with a baby;

transmitting the sound to a remote location;

receiving the sound at the remote location;

selectively activating a vibration unit at the remote based on one or more properties of the sound associated with an environment of the baby.

6. The method of claim 5 wherein the property of sound is ambient volume.

7. The method of claim 6 wherein the ambient sound volume is in part generated by the baby.

8. The method of claim 5 further comprising manually adjusting a level of vibration.

9. The method of claim 5 wherein the step of selectively activating comprises setting a threshold such that the vibration unit is activated when the threshold is exceeded.

10. The method of claim 9 wherein the vibration unit remains activated for as long as the threshold is exceeded.

* * * * *